United States Patent [19]

Gotta et al.

[11] 4,003,761

[45] Jan. 18, 1977

[54] PROCESS FOR THE PRODUCTION OF SPRAYED PHOSPHATE COATS ON IRON AND STEEL

[75] Inventors: Hans Gotta, Weiden; Franz-Heinz Schroll, Hurth, both of Germany

[73] Assignee: Gerhard Collardin GmbH, Cologne-Ehrenfeld, Germany

[22] Filed: Apr. 2, 1975

[21] Appl. No.: 564,556

[30] Foreign Application Priority Data

Apr. 13, 1974 Germany ..... 2418118
Feb. 7, 1975 Germany ..... 2505172

[52] U.S. Cl. ..... 148/6.15 R; 148/6.15 Z; 106/14; 252/389 A

[51] Int. Cl.[2] ..... C23F 7/08

[58] Field of Search ..... 148/6.15 R, 6.15 Z; 252/389 A; 106/14

[56] References Cited

UNITED STATES PATENTS

| | | | |
|---|---|---|---|
| 2,250,508 | 7/1941 | Thompson et al. | 148/6.15 R |
| 2,657,156 | 10/1953 | Hyams et al. | 148/6.15 R |
| 2,744,555 | 5/1956 | Nicholson et al. | 148/6.15 R |
| 2,987,428 | 6/1961 | Heller et al. | 148/6.15 R |
| 3,166,444 | 1/1965 | Ehren et al. | 148/6.15 Z |
| 3,368,913 | 2/1968 | Zehr et al. | 148/6.15 R |
| 3,484,304 | 12/1969 | Beach | 148/6.15 R |
| 3,660,127 | 5/1972 | Aronberg | 148/6.15 R |
| 3,764,353 | 10/1973 | Shimiyu et al. | 148/6.15 R |

*Primary Examiner*—Ralph S. Kendall
*Assistant Examiner*—Charles R. Wolfe, Jr.
*Attorney, Agent, or Firm*—Hammond & Littell

[57] ABSTRACT

In the process for applying a phosphate coating to a ferric surface which comprises spraying an aqueous acidic solution at a pH of 4.3 to 6.5 containing an orthophosphate salt of a cation selected from the group consisting of alkali metals and ammonium, in the presence of oxidizing agent or reducing agent accelerators onto said surface, the improvement consisting of adding to said aqueous acidic solution from 0.05 to 1 gm per liter of a short-chain alkylolamine having from 2 to 4 carbon atoms in each alkylol and from 0.01 to 1.5 gm per liter of at least one non-ionic surface-active wetting agent.

10 Claims, No Drawings

PROCESS FOR THE PRODUCTION OF SPRAYED PHOSPHATE COATS ON IRON AND STEEL

It has been known for a long time to produce iron phosphate coats on ferric surfaces such as iron and steel surfaces, where alkali metal and/or ammonium orthophosphate solutions with a pH value of 4.3 to 6.5 are used. These solutions also frequently contain an addition of oxidizing agents or reducing agents for acceleration, wetting agents and emulsifiers, if a simultaneous cleaning is to be effected. The iron phosphatizing process can be effected both by dripping and spraying.

These processes suffer the drawback, however, as corrosion can occur under subsequently applied coatings.

An object of the present invention is the development of a process for applying a phosphate coating to a ferric surface which can be applied by spraying and which effects a better corrosion protection, compared to the present methods.

Another object of the present invention is the development of a process for applying a phosphate coating to a ferric surface, which phosphate coating is particularly suitable for the application of additional coats, particularly varnishes or plastic coatings.

A further object of the present invention is the development, in the process for applying a phosphate coating to a ferric surface which comprises spraying an aqueous acidic solution at a pH of 4.3 to 6.5 containing an orthophosphate salt of a cation selected from the group consisting of alkali metals and ammonium, in the presence of oxidizing agent or reducing agent accelerators onto said surface, the improvement consisting of adding to said aqueous acidic solution from 0.05 to 1 gm per liter of a short-chain alkylolamine having from 2 to 4 carbon atoms in each alkylol and from 0.01 to 1.5 gm per liter of at least one non-ionic surface-active wetting agent.

These and other objects of the invention will become more apparent as the description thereof proceeds.

The above objects have been achieved by the present invention which involves the production of particularly corrosion-resistant phosphate coats suitable for the application of additional coats. The production of the phosphate coats is effected with acid solutions based on alkali metal and/or ammonium orthophosphate which contain special additions.

The process of the invention involves an improvement in the production of phosphate coats by spraying acid solutions based on alkali metal and/or ammonium orthophosphate with a pH value of 4.3 to 6.5, as well as an addition of accelerators on iron and steel.

The new method is characterized in that the alkali metal phosphate solution contains from 0.05 to 1 gm per liter of short-chain alkylolamines and from 0.01 to 1.5 gm per liter of nonionic wetting agents.

In particular the present invention involves, in the process for applying a phosphate coating to a ferric surface which comprises spraying an aqueous acidic solution at a pH of 4.3 to 6.5 containing an orthophosphate salt of a cation selected from the group consisting of alkali metals and ammonium in the presence of oxidizing agent or reducing agent accelerators onto said surface, the improvement consisting of adding to said aqueous acidic solution from 0.05 to 1 gm per liter of a short-chain alkylolamine having from 2 to 4 carbon atoms in each alkylol group and from 0.01 to 1.5 gm per liter of at least one non-ionic surface-active wetting agent.

The acid phosphate solutions used contain orthophosphates in a concentration of about 1.0 to 20.0 gm per liter in the form of the alkali metal and/or ammonium phosphates, such as sodium, potassium, and/or ammonium orthophosphate.

The oxidizing agent or reducing agent accelerators are such compounds as alkali metal nitrites, alkali metal perborates, alkali metal bromates, hydroxylamine salts, as well as alkali metal or ammonium molybdates. Furthermore, organic nitro compounds can be used, such as nitrobenzoic acid, nitroguanadine, nitroresorcinol and nitrated benzene sulfonic acids, for example, m-nitrobenzene sulfonic acid. The accelerators are used in amounts of 0.05 to 5 gm per liter, preferably 0.1 to 3 gm per liter.

Suitable short-chain alkylolamines are those having from 2 to 4 carbon atoms in each alkylol group, particularly monoethylolamine, diethylolamine, triethylolamine and the corresponding propylolamines.

The non-ionic surface-active wetting agents are, in particular, the water-soluble reaction products of ethylene oxide alone or with propylene oxide, with organic compounds having an active hydrogen atom and a hydrophobic moiety of at least 8 carbon atoms, such as alkylphenols having from 8 to 20 carbon atoms in the alkyl, higher fatty alcohols having from 8 to 20 carbon atoms, higher fatty acid amides having from 8 to 20 carbon atoms, etc. The turbidity point of the wetting agents used is generally between 20° and 70° C.

The duration of the treatment of the iron and steel surfaces in the spraying process is 0.5 to 5, preferably, 2 to 4 minutes. The process can be carried out at temperatures between 40° and 95° C, preferably 50° to 70° C.

It was also found that the good corrosion protection achieved with the above described procedure can be further improved if the solutions also contain aliphatic monocarboxylic acids with 6 to 10 carbon atoms or aromatic monocarboxylic acids in the form of benzoic acid or alkylated benzoic acid in amounts of 0.05 to 0.5 gm per liter in each case. The aliphatic monocarboxylic acids which can be used are particularly alkanoic acids having 6 to 10 carbon atoms, such as capronic acid, caprylic acid, as well as capric acid. The alkylated benzoic acids are preferably those with an alkyl substituent of 1 to 4 carbon atoms, like methylbenzoic acid, ethylbenzoic acid, propylbenzoic acid, and particularly p-(tert.butyl)-benzoic acid.

A special embodiment of the process consists in that the phosphatization is effected in two stages, with the concentration of orthophosphate being increased in the second stage by about 50% to 100%, compared to the first stage. Furthermore, it was found that it is generally of advantage in this two-stage process if the tenside concentration of non-ionic wetting agents, which is between 0.1 and 1.5 gm per liter, is reduced in the second stage by about 20% to 30%, compared to the first stage.

In some cases it is of advantage, particular if a variation of the coat thickness is desired, to add polycondensed phosphates to the acid solutions containing alkali metal and/or ammonium orthophosphates. Specifically, additions of sodium tripolyphosphate and especially sodium pyrophosphate can be used. Polycondensed phosphates are added in an amount of about 0.01 to 0.1 gm per liter.

By means of the above described phosphating solution it is possible to produce under the above mentioned conditions phosphate coats on iron and steel which provide excellent protection against corrosion. The coat thicknesses are over 0.8 gm/m². With a corresponding longer treatment, coat thicknesses of 1.2 gm/m² can be obtained. The process, furthermore, has the advantage that it is merely necessary to rinse the phosphate coat with water before the additional coats are applied so that the customary after-treatment with chromatizing solution can be eliminated.

The phosphate coats are particularly suitable for the application of additional coats by electrostatic wet varnish coating, electrostatic powder coating, or particularly electrophoretic dip varnishings with water-soluble varnishes. The coats have a good impact resistance.

The following examples are illustrative of the practice of the invention without being limitative in any respect.

EXAMPLE 1 a. Deep-drawn quality steel sheets were treated in the spraying process at a temperature of 65° C and a spraying pressure of 1.5 kg/cm² for 3 minutes with an acid solution of the following composition:

9 gm/l of a primary sodium orthophosphate
0.4 gm/l of hydroxylamine sulfate
0.6 gm/l of a non-ionic wetting agent (addition product of 10 mols of ethylene oxide to nonylphenol)
0.4 gm/l of diethylolamine.

b. Another series of deep-drawn quality sheets was treated with same procedure with an acid solution of the composition indicated under (a), which contained, however, in addition 0.2 gm/l of caprylic acid.

c. In a third series (comparison test) the treatment was effected with an acid solution according to (a) which did not contain the diethylolamine.

The pH-values in the solutions (a), (b) and (c) were adjusted with sodium hydroxide solution to 5.4 in each case.

The sheets which were processed according to (a) to (c) were further coated with a gray prime coat applied by electrodipping, as it is customary in the automobile industry. The coat thickness was about 18 microns.

The coated sample sheets were subject to the salt-spray test according to SS DIN 50,021 with cross-cut. After an exposure for over 240 hours to the salt spray, the evaluation according to the degree of blistering on the surface (DIN 53,209) and the subsurface rusting in mm, starting from the cross cut, are indicated in the following Table I where the value indicated under (c) represents the reference example without the additions according to the invention.

TABLE I

| Treatment Solution | (a) | (b) | (c) |
|---|---|---|---|
| Degree of blistering DIN 53,209 | mO/gO | mO/gO | ml/g3 |
| Rust in the cross-cut | 2–3 mm | 1.5–2 mm | 6–7 mm |

EXAMPLE 2

Deep-drawn quality steel sheets were treated in the spraying process at a temperature of about 65° C and a spraying pressure of 1.5 kp/m² for 90 seconds with a solution of the following composition:

7 gm/l of primary sodium orthophosphate
0.4 gm/l of hydroxylamine phosphate
0.7 gm/l of a non-ionic wetting agent (addition product of 10 mols of ethylene oxide to nonylphenol)
0.3 gm/l of diethylolamine
0.2 gm/l of capronic acid Subsequently, an additional treatment was applied for 90 seconds with a solution which contained:

11 gm/l of primary sodium orthophosphate
0.4 gm/l of hydroxylamine phosphate
0.5 gm/l of a non-ionic wetting agent (addition product of 10 mols of ethylene oxide to nonylphenol)
0.3 gm/l of diethylolamine
0.2 gm/l of capronic acid These treated sheets were then rinsed first with tap water and then with deionized water and dried in a hot air current.

The further coating was effected with a prime coat applied by electrodipping, as described in Example 1.

These treated sheets showed practically the same values as indicated in Table 1 under (b). The service life of the phosphatizing baths, however, is considerably increased by the two-stage process.

EXAMPLE 3 a. Deep-drawn quality steel sheets were treated in the spraying process at a temperature of 65° C and at a spraying pressure of 1.5 kp/cm² for 3 minutes with an acid solution of the following composition:

9 gm/l of primary sodium orthophosphate
0.4 gm/l of hydroxylamine phosphate
0.6 gm/l of non-ionic wetting agent (addition paroduct of 10 mols of ethylene oxide to nonylphenol)
0.4 gm/l of diethylolamine.

b. Another series of the deep-drawing quality sheets was treated in the same procedure with an acid solution of the composition indicated under (a) which contained, however, in addition 0.2 gm/l of p-(tert, butyl)-benzoic acid.

c. In a third series (comparison test) the treatment was effected with an acid solution according to (a) which did not, however, contain an addition of diethylolamine.

The pH value in the solutions (a), (b) and (c) was adjusted with sodium hydroxide solution to 5.4.

The sheets coated according to (a) to (c) were subsequently coated with a gray prime coat applied by electrodipping as is customary in the automobile industry. The coat thickness was about 18 microns.

The coated sample sheets were subject to the salt spray test according to SS DIN 50,021 with cross-cut. After exposure for over 240 hours to the salt spray, the evaluation of the degree of blistering on the surface (DIN 53,209) and the subsurface rusting in mm, starting from the cross-cut, are indicated in Table II below, where the value indicated under (c) represent the reference example without the additions according to the invention.

TABLE II

| Treatment Solution | (a) | (b) | (c) |
|---|---|---|---|
| Degree of blistering DIN 53,209 | mO/gO | mO/gO | ml/g3 |
| Rust in the cross-cut | 2–3 mm | 1.0–1.5 mm | 6–7 mm |

The value for (b) is slightly better than that for Example 1 (b), where the same amount of caprylic acid was employed.

EXAMPLE 4

Deep-drawn quality steel sheets were treated in the spraying process at a temperature of about 65° C and a spraying pressure of 1.5 kp/cm² for 90 seconds with an acid solution of the following composition:

7 gm/l of primary sodium orthophosphate
0.4 gm/l of hydroxylamine phosphate
0.7 gm/l of a non-ionic wetting agent (addition product of 10 mols of ethylene oxide to nonylphenol)
0.3 gm/l of triethylolamine
0.2 gm/l of benzoic acid Subsequently, an additional treatment was applied for 90 seconds with an acid solution which contained:

11 gm/l of primary sodium orthophosphate
0.4 gm/l of hydroxylamine phosphate
0.5 gm/l of non-ionic wetting agent (addition product of 10 mols of ethylene oxide to nonylphenol)
0.3 gm/l of triethylolamine
0.2 gm/l of benzoic acid The pretreated sheets were first rinsed with tap water and then with deionized water and dried in a hot air current.

The further coating with a prime coat applied by electrodipping was effected as described in Example 1.

These treated sheets showed practically the same corrosion-values as indicated in Table I under (b). The service life of the phosphatizing baths, however, is substantially increased by the two-stage process.

In the same spraying process results a thicker phosphate coating, if the acid solution of the additional treatment further contains 0.03 g/l sodium tripolyphosphate.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A process for forming a phosphate coating on a corrodible ferric surface, thereby rendering said surface corrosion resistant which comprises spraying said surface for 0.5 to 5 minutes with a solution having a pH of 4.3 to 6.5 consisting essentially of 1 to 20 g./liter of an orthophosphate salt of a cation selected from the group consisting of alkali metals and ammonium, 0.05 to 5 g./liter of an oxidizing agent or reducing agent accelerator, 0.05 to 1 g./liter of a short-chain alkylolamine having from 2 to 4 carbon atoms in each alkylol group from 0.01 to 1.5 g./liter of at least one non-ionic wetting agent and the remainder water at a temperature in the range of about 40° to 95° C.

2. The process of claim 1 wherein said accelerator is selected from the group consisting of alkali metal nitrites, alkali metal perborates, alkali metal bromates, alkali metal and ammonium molybdates, hydroxylamine salts and organic nitro compounds.

3. The process of claim 1 wherein the spraying is effected in two stages and the concentration of the orthophosphate salt is larger by about 50% to 100% in the second stage than in the first stage.

4. The process of claim 3 wherein the concentration of the wetting agent is smaller by about 20% to 30% in the second state than in the first stage.

5. The process of claim 1 wherein said aqueous acidic solution contains polycondensed phosphates in addition to said orthophosphate salts.

6. The process of claim 1 wherein, after said acidic solution is sprayed on said ferric surface, said ferric surface is rinsed with water.

7. The process of claim 1 wherein said acidic solution has a further content of from 0.05 to 0.5 gm per liter of at last one alkanoic acid having from 6 to 10 carbon atoms.

8. The process of claim 1 wherein said acidic solution has a further content of from 0.05 to 0.5 gm per liter of at least one aromatic carboxylic acid selected from the group consisting of benzoic acid and alkylated benzoic acids having 1 to 4 carbon atoms in the alkyl group thereof.

9. A substantially anhydrous composition which when diluted with water to 1,000 parts by weight is useful for rendering corrodible ferrous surface corrosion resistant consisting essentially of 1 to 20 parts by weight of an orthophosphate salt of a cation selected from the group consisting of alkali metals and ammonium, 0.05 to 5 parts of an oxidizing or reducing accelerator, 0.05 to 1 part of a $C_2$ -$C_4$ alkanolamine, and 0.01 to 1.5 parts of a non-ionic wetting agent, and an acid or alkali to provide a pH between 4.3 and 6.5 when said composition is dissolved in water to 1,000 parts by weight.

10. A composition useful for the phosphatizing of corrodible ferrous surfaces, consisting essentially of 1 to 20 g./liter of an orthophosphate salt of a cation selected from the group consisting of alkali metals and ammonium, 0.05 to 5 g./liter of an oxidizing or reducing accelerator, 0.05 to 1 g./liter of a $C_2$ –$C_4$ alkanolamine, and 0.01 to 1.5 g./liter of a non-ionic wetting agent, and the remainer water; said solution having a pH between 4.3 and 6.5.

* * * * *